United States Patent [19]

Ogoshi et al.

[11] Patent Number: 4,562,875

[45] Date of Patent: Jan. 7, 1986

[54] DIE-CASTING METHOD AND APPARATUS

[75] Inventors: Yutaka Ogoshi, Kariya; Mitsuyoshi Yokoi, Takahama; Fumitaka Takehisa, Anjou; Sumi Yoshikawa, Nakashima, all of Japan

[73] Assignee: Nippondense Co., Ltd., Kariya, Japan

[21] Appl. No.: 645,395

[22] Filed: Aug. 29, 1984

[30] Foreign Application Priority Data

Aug. 30, 1983 [JP] Japan ..... 58-159382
Jul. 6, 1984 [JP] Japan ..... 59-140965

[51] Int. Cl.[4] ..... B22C 23/02; B22D 17/04

[52] U.S. Cl. ..... 164/72; 164/267; 164/312; 164/113

[58] Field of Search ..... 164/72, 267, 74, 312, 164/113, 119–121

[56] References Cited

U.S. PATENT DOCUMENTS 3,645,319 2/1972 Pondelicek et al. ..... 164/72
3,779,305 12/1973 Pondelicek et al. ..... 164/72

FOREIGN PATENT DOCUMENTS 1489346 8/1966 France ..... 164/267
880619 11/1981 U.S.S.R. ..... 164/267

*Primary Examiner*—Nicholas P. Godici
*Assistant Examiner*—Samuel M. Heinrich
*Attorney, Agent, or Firm*—Cushman, Darby & Cushman

[57] ABSTRACT

A die-casting method that eliminates the need to inject insulation. By injecting molten metal sufficiently quickly after injecting tip lubricant, die-cast products may be removed from the mold even without injecting isulation. To this end, a movable die may at least begin moving toward a fixed die before tip lubricant is injected. The tip lubricant may be injected from a molten metal pouring port in a shot sleeve or from the movable die toward the shot sleeve. Tip lubricant which has been introduced into the shot sleeve is conveyed into the die cavity by movement of the molten metal, thus coating the die cavity inner surface.

11 Claims, 13 Drawing Figures

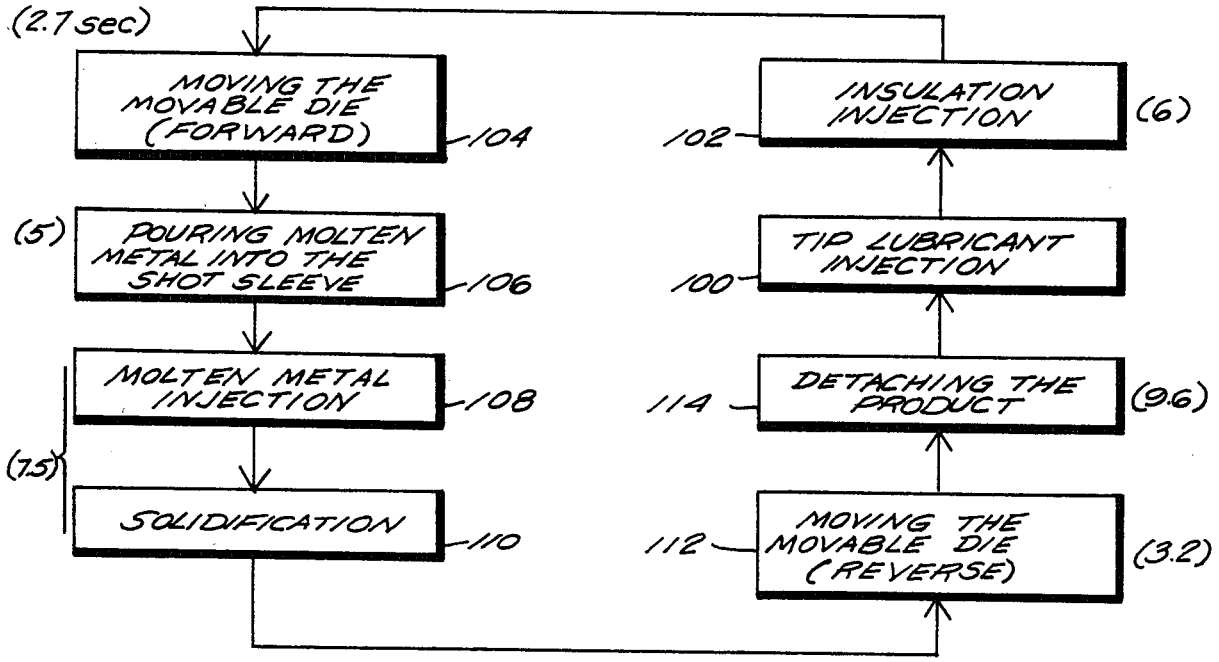
Fig. 1 (PRIOR ART)
Fig. 8
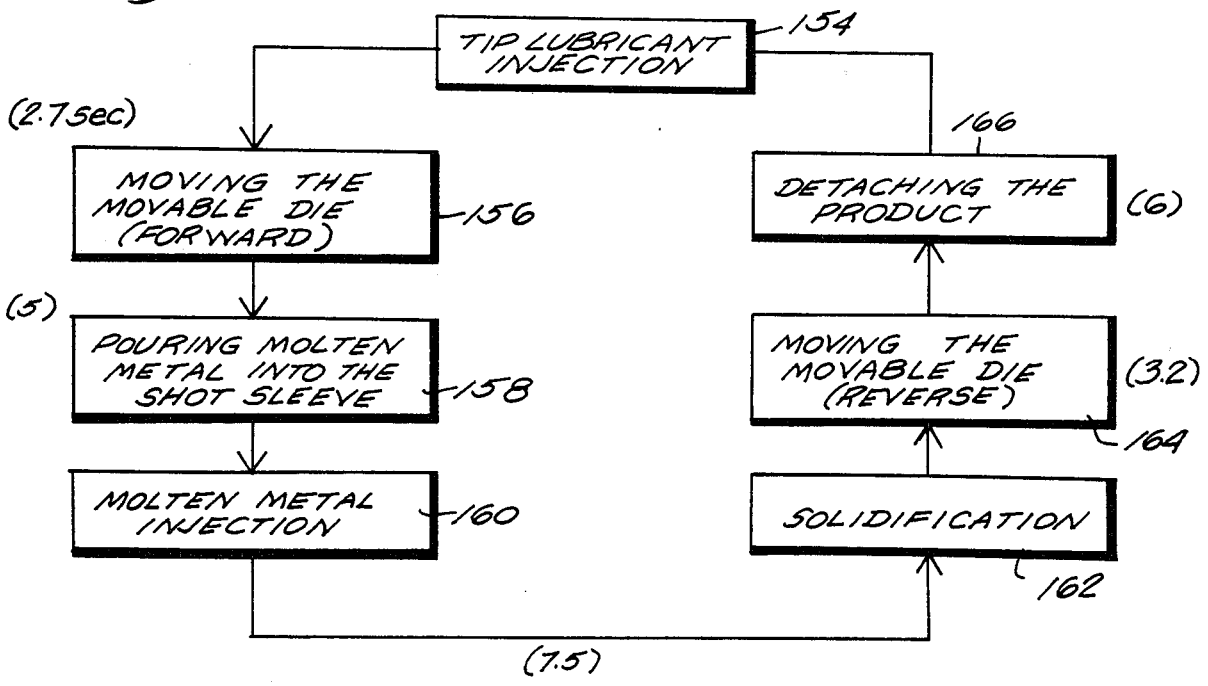

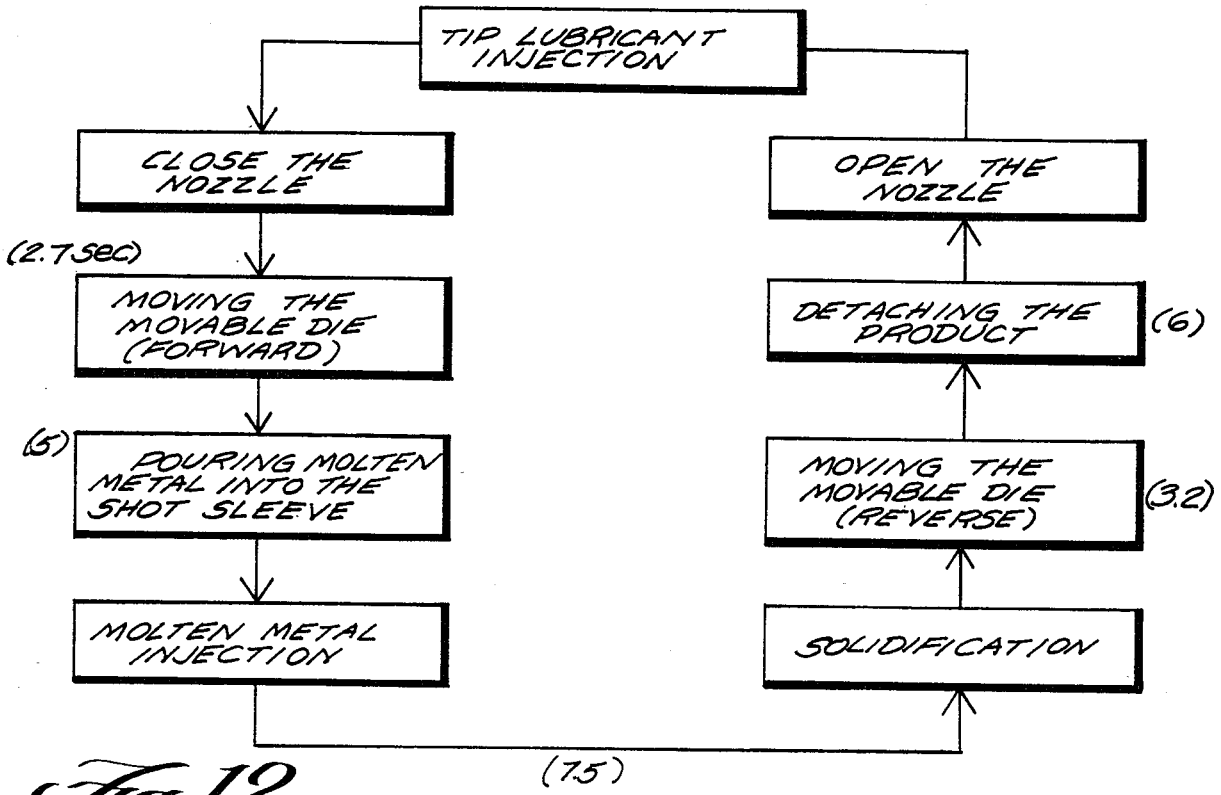
Fig. 12
Fig. 13
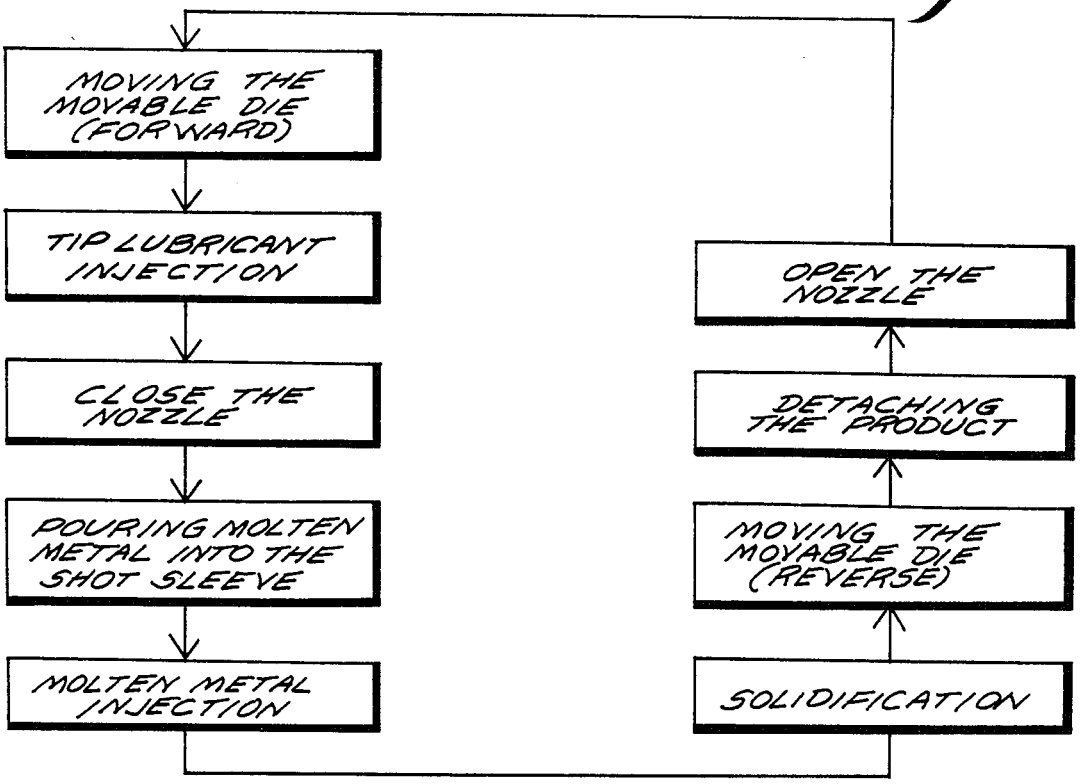

DIE-CASTING METHOD AND APPARATUS

BACKGROUND OF THE INVENTION

1. Field of the Invention

This invention relates to a die-casting method and an apparatus used for the method. The products made by the present die-casting method include, for example, automotive distributor housings.

2. Description of the Prior Art

A conventional die-casting method includes the steps shown in FIG. 1. First, at step 100, a tip lubricant is injected into an inner surface of a shot sleeve when a movable die separates from a fixed die. Then, at step 102, insulation is injected over the surface of both the movable die and the fixed die. After that, at step 104, the movable die is moved into contact with the fixed die so that a die cavity is formed therebetween. Molten metal is poured into the shot sleeve at step 106 and is injected into the die cavity afterwards at step 108. After the metal solidifies in the die cavity at step 110, the movable die is detached from the fixed die at step 112. Finally, the product, namely the solidified metal, is pushed out from the die cavity at step 114.

SUMMARY OF THE INVENTION

The present inventors have studied the conventional die casting method described above and have found out that the tip lubricant influences the detaching force necessary to push the product out from the movable die. Specifically, the present inventors have found that the tip lubricant can-work not only as a lubricant between the inner surface of a shot sleeve and the outer surface of a shot rod, but it can also work as an insulation that reduces adhesion between the product and the inner surfaces of both the fixed die and also between the product and the inner surface of the movable die.

To explore this further, the present inventors have done die-casting without tip lubricant and without insulation. They observed that the detaching force (the force required for detaching the product from the movable die) increases with the number of die-casting shots. As shown in FIG. 2, the product could not be detached from the movable die after five die-casting shots without the tip lubricant. The present inventors then studied the efficiency of the tip lubricant for reducing the detaching force. In these studies, tip lubricant was injected with high pressure air. The time lag from the moment the tip lubricant is fully injected until the movable die seals with the fixed die greatly influences efficiency as shown in FIG. 3. FIG. 3 shows clearly that as the time lag t becomes shorter, the detaching force becomes smaller.

It is believed that since the tip lubricant is injected into shot sleeve 116 with a high pressure air, as shown in FIG. 4, and shot sleeve 116 is heated by the molten metal from previous castings, it is easy for the tip lubricant to leak out from opening 118. Therefore, when the time lag t is so long, a lot of tip lubricant disperses from shot sleeve 116.

The present invention provides a diecasting method and apparatus which uses the tiplubricant most efficiently, while reducing the cycle time required to complete each casting. Also, the present invention prevents the generation of creases on the product.

According to the present invention, the movable die moves toward the fixed die as soon as possible after the tip lubricant is injected. In fact, the movable die may move toward the fixed die even before the tip lubricant is injected. As a resullt, die-casting according to the present invention need not employ the insulation injection step of conventional die-casting. Therefore, die-casting according to the present invention reduces the time to complete each casting. Though the required time for insulation injection depends upon the volume of the die cavity, the average time for insulation injection is approximately 10 seconds, which represents the time saved by the present invention for each casting.

BRIEF DESCRIPTION OF THE DRAWING

These and other objects and advantages of this invention will become more apparent and more readily appreciated from the following detailed description of the presently preferred exemplary embodiments of the invention taken in conjunction with the accompanying drawings, of which:

FIG. 1 is a flow chart showing the steps of conventional die-casting method;

FIG. 8 is a flow chart showing the steps of the die-casting method of the present invention;

FIG. 12 is a flow chart showing steps of the die-casting method using apparatus shown in FIG. 10; and FIG. 13 is another flow chart showing steps of another die-casting method using the apparatus shown in FIG. 10.

DETAILED DESCRIPTION OF THE PRESENTLY PREFERRED EXEMPLARY EMBODIMENTS

Figure 5:
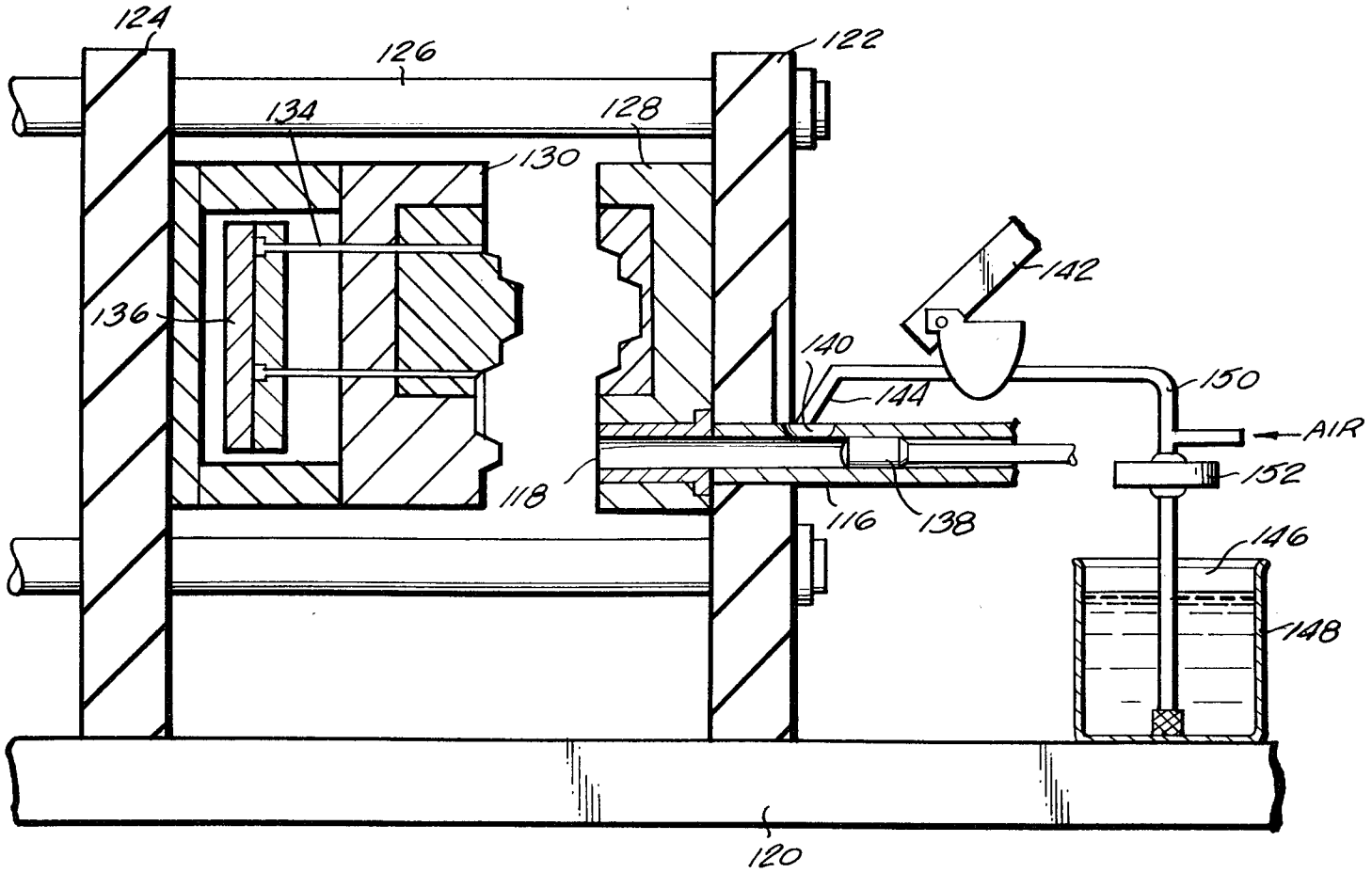
FIG. 5 is a schematic sectional view of the die-casting apparatus of the present invention.

FIG. 5, showing an embodiment of a die-casting apparatus according to this invention, includes a fixed base 120 which is bolted to the floor of a factory. A fixed platen 122 is attached to fixed base 120. Although only a single fixed platen 122 is expressly shown in FIG. 5, the die-casting apparatus, in fact, has a couple of fixed platens. A movable platen 124 is provided between fixed platens 122. Movable platen 124 is moved along tie bars 126 by an oil pressure piston (not shown).

A fixed die 128 is attached to fixed platen 122, and a movable die 130 is attached to movable platen 124. Die cavity 132 is formed between fixed die 128 and movable die 130 when movable die 130 closes with fixed die 128. Ejector pins 134 are slidably inserted in movable die 130. Ejector pins 134, which are moved by an oil pressure piston (not shown) via ejector plate 136, eject a product from movable die 130.

Shot sleeve 116, along with a shot plunger 138 which moves in shot sleeve 116 in an air-tight manner, is provided in fixed die 128. Shot plunger 138 is reciprocated by an oil pressure piston (not shown). A pouring port 140 through which molten metal is poured into shot sleeve 116 opens at the upper side of the shot sleeve 116. A carrier 142 carries molten metal to pouring port 140.

An injection nozzle 144, through which tip lubricant is injected, faces pouring port 140. The tip lubricant is injected toward shot sleeve 116 as follows. Tip lubricant 146 in tank 148 is pumped up to the level of an airpath 150 by a pump 152, then is mixed with high pressure air (4~5 kg/cm$^2$). After that, tip lubricant 146 with high pressure air is injected from nozzle 144 into shot sleeve 116. The tip lubricant of this embodiment is an oleaginous one, since the efficiency of reducing the detach force of the oleaginous lubricant is better than that of the aqueous lubricant.

Figure 2:
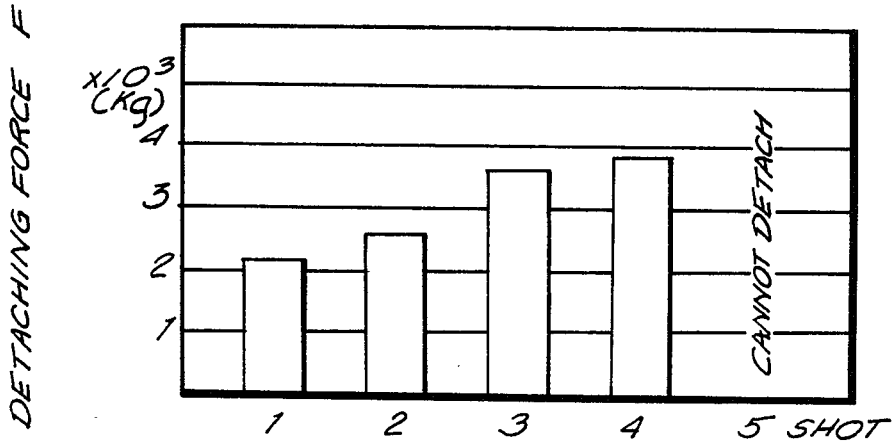
FIG. 2 is a graph showing the relation between the detaching force and number of shots when die-casting is done without the tip lubricant.
Figure 3:
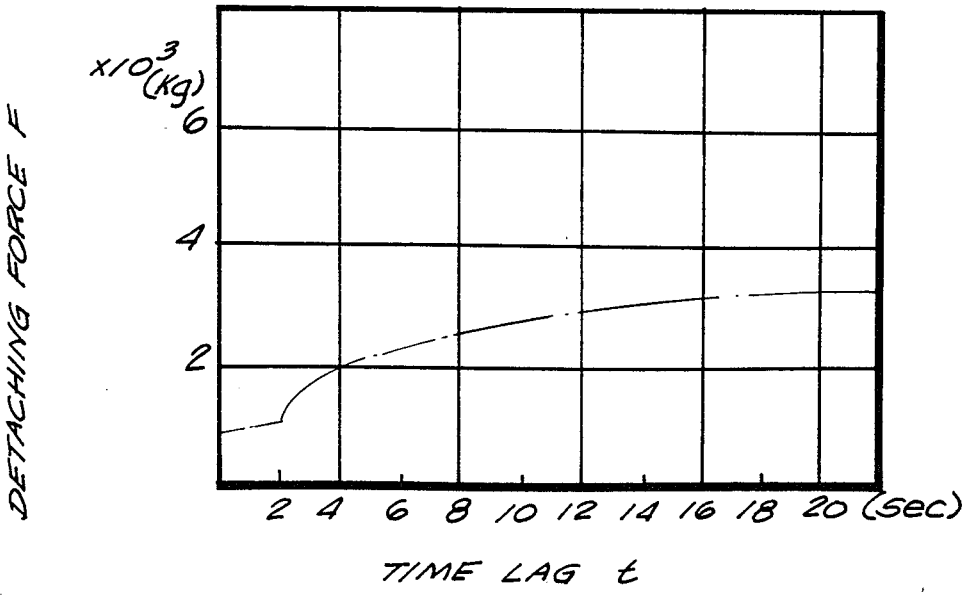
FIG. 3 is a graph showing a relationship between the detaching force and the time lag from tip lubricant injection to mold closing.
Figure 4:
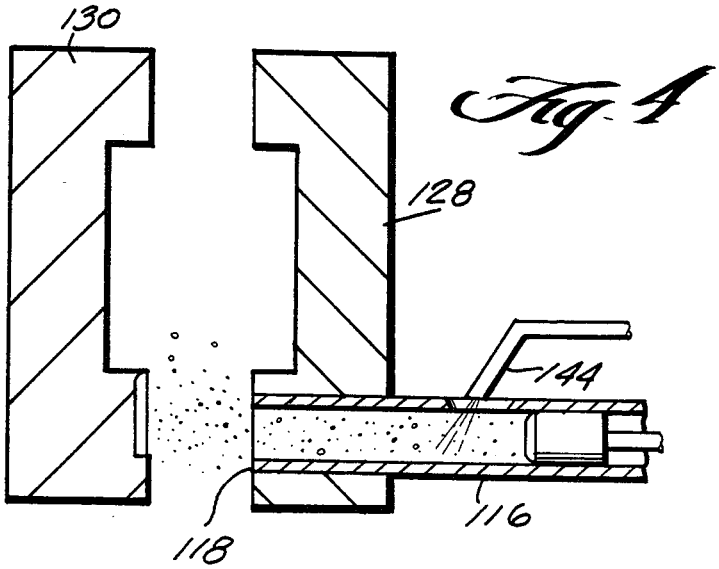
FIG. 4 is a schematic sectional view of the shot sleeve when the tip lubricant is injected.

A flow chart of the die-casting method using the apparatus described above is shown in FIG. 8. At step 154, approximately 2.5 cc, for example, of tip lubricant 148 is mixed with air and is injected into shot sleeve 116, with pressurized air so as to coat the inner surface of shot sleeve 116 with a mist of tip lubricant 148, while movable die 130 is separated from fixed die 128 as shown in FIG. 4. Directly after that, at step 156, movable platen 124 is moved so that movable die 130 closes with fixed die 128 to form die cavity 128 between dies 128 and 130. The time required for moving movable platen 124 is, for example, about 2.7 sec.

The die-casting method of the present invention skips the conventional step of insulation injection in order to close movable die 130 with fixed die 128 as soon as possible. In other words, the die-casting method of this invention can prevent the dispersion of the tip lubricant, so that the reduction of the detaching force caused by the tip lubricant is effectively employed.

Figure 6:
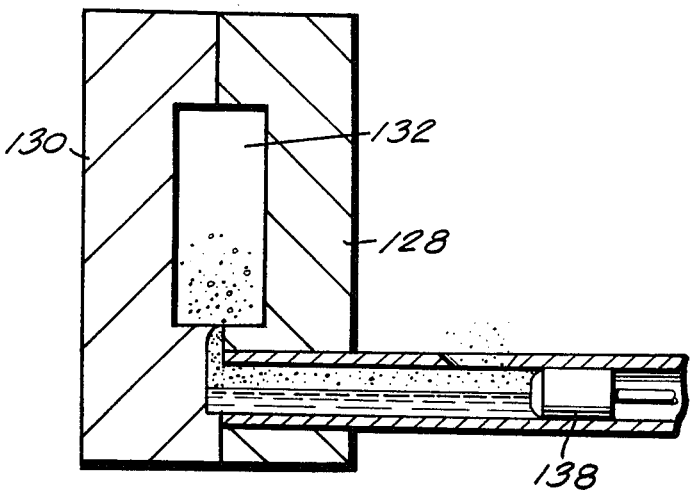
FIGS. 6 and 7 are schematic sectional views of the die and the shot sleeve showing the flow of molten metal.
Figure 7:
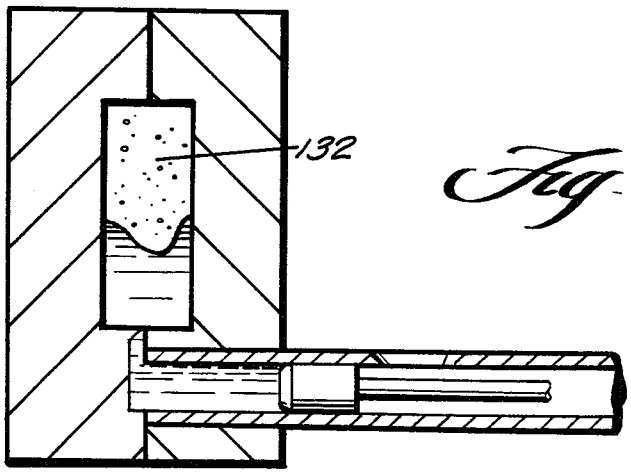

After lubricant injection, the molten metal is poured into shot sleeve 116 from carrier 142 at step 158. The time required for pouring the molten metal is, for example, about 5 sec. Then, at step 160 shot plunger 138 progresses toward die cavity 128 by the following manner. The progressive speed of shot plunger 138 is relatively slow (0.2 m/sec.) before the molten metal goes into die cavity 132, as shown in FIG. 6. After the molten metal reaches die cavity 132, as shown in FIG. 7, the progressive speed increases to a relatively high value (1.3 m/sec.).

In accordance with the progressive movement of shot plunger 138, die cavity 132 is filled with the molten metal, and the metal in die cavity 132 is pressurized (about 1260 kg/cm$^2$) by shot plunger 138 until the metal becomes solidified at step 162. The time required for solidification of the metal of this embodiment is about 7.5 sec.

At step 160 in which the molten metal is injected into die cavity 132, the tip lubricant, which became atomized by the energy of the high pressure air and/or by the energy of shot plunger 138, is conveyed into die cavity 132 ahead of the molten metal. Accordingly, the atomized tip lubricant coats the inner surfaces of fixed die 128 and movable die 130 first. Then the molten metal touches the inner surface of dies 128 and 130 covered with the atomized tip lubricant.

At step 164, after die cavity 132 is filled with the molten metal and the metal solidifies, movable platen 124 is moved in order to separate movable die 130 from fixed die 128. Also, ejector plate 136 is moved at step 166 to detach the product from movable die 130 with ejector pin 134. The die-casting apparatus of this embodiment needs about 3.2 sec. for the movement of movable die 130 and also needs about 9.6 sec. for the movement of ejector plate 136.

The die-casting method of this invention uses the full benefit of the tip lubricant, i.e., the detaching force reduction effect, so that the product can detach from movable die 130 smoothly, even though insulation is not employed. Furthermore, since the die-casting method of this invention does not use a conventional insulation, the generation of creases on the product is prevented for the following reasons. Movable and fixed dies 130 and 128 cool as the insulation attaches thereon. Therefore, a solidified metal layer is generated on the surface of dies 128 and 130 just after the molten metal touches their surfaces. It is thought that this rapid generation of the solidified layer creates creases. It is also thought that the insulation is transformed by the high temperature of the molten metal into a gas phase. Since the gas obstructs the flow of molten metal, the molten metal becomes turbulent in die cavity 132, thus forming creases.

Figure 9:
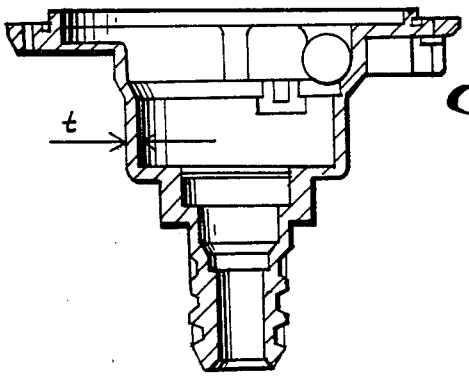
FIG. 9 is a sectional view of the die-casting product.

FIG. 9 shows a sample of the product which is used as a housing of an automotive distributor. As understood from FIG. 9, the thickness t of the product of this embodiment is relatively thin (about 1.5 mm). The inventors have determined that as the thickness t decreases, the required detaching force also decreases.

Accordingly, a greater amount of tip lubricant is needed when the product has a large thickness t. Not as much tip lubricant is needed when the thickness t of the product is small. Although the apparatus described above has nozzle 144 which opens at pouring port 140, it is clear that nozzle 144 can open anywhere in shot sleeve 116, namely anywhere upstream from die cavity 132.

Figure 10:
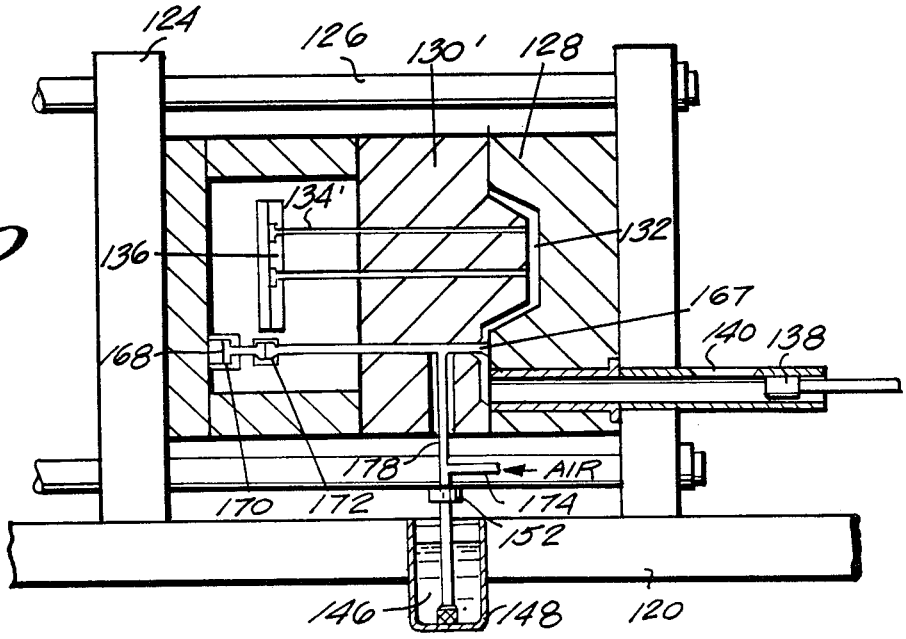
FIG. 10 is a schematic sectional view of the die-casting apparatus according to another embodiment of this invention.

The die-casting apparatus shown in FIG. 10 has a nozzle 167' which is provided in movable die 130'. Nozzle 167 of the apparatus is connected with a piston 168 in the cylinder 170 via a coupling 172 and, therefore, is reciprocated by piston 168.

Figure 11:
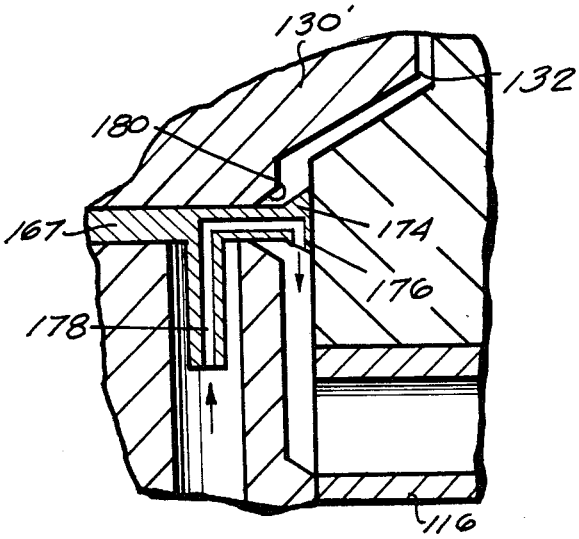
FIG. 11 is a schematic sectional view of the nozzle shown in FIG. 10.

Nozzle 167 of this apparatus has a taper shaped valve portion 177 at the top thereof, as shown in FIG. 11. Air path 178 is formed in nozzle 167, and end 176 of air path 178 is opened on the bottom side of valve portion 167 in FIG. 11, so that end 176 faces shot sleeve 116. Movable die 130' of this apparatus also has a taper shaped surface 180 at the opposite portion of valve portion 177. Therefore, valve portion 177 can switch between the first position when the valve portion 177 seats on surface 180 and the second position when valve portion 177 separates from surface 180, in accordance with the movement of piston 168. Air path 178 is closed when valve portion 177 is in the first position, and is opened when valve portion 177 is the second position. When valve portion 177 is in the second position, tip lubricant is injected from nozzle 167 into shot sleeve 116.

With this embodiment, the injection timing of tip lubricant can be controlled by the reciprocation of nozzle 167. Accordingly, the tip lubricant can be injected before movable die 130' moves, as suggested in FIG. 12, and also can be injected after movable die 130' contact fixed die 128, as shown in FIG. 13.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A method of die-casting employing a fixed die, a movable die defining a die cavity between the inner surface thereof and the inner surface of said fixed die when said movable die contacts said fixed die, and a shot sleeve opening into said die cavity through which molten metal is injected, said method comprising the steps of:

introducing tip lubricant into said shot sleeve so as to keep substantially all of said tip lubricant in said shot sleeve;

moving said movable die to contact said fixed die, so that said die cavity is formed, said moving step being performed directly after said introducing step with no intermediate injection of any substance into said shot sleeve or said die cavity therebetween;

pouring molten metal into said shot sleeve;

injecting said molten metal into said die cavity to cause said tip lubricant to be conveyed into said die cavity by the movement of said molten metal so as to coat the inner surface of said die cavity prior to said molten metal touching said die cavity inner surface;

solidifying said metal in said die cavity; and separating said movable die from said fixed die and detaching the solidification metal from said die cavity.

2. A die-casting method as in claim 1 wherein said introducing step introduces said tip lubricant into said shot sleeve through a pouring port of said shot sleeve.

3. A die-casting method as in claim 1 wherein said introducing step introduces said tip lubricant into said shot sleeve from a passage between said die cavity and said shot sleeve.

4. A die-casting method as in claim 1 wherein said introducing step introduces said tip lubricant into said shot sleeve with a high pressure air.

5. A method of die-casting employing a fixed die, a movable die defining a die cavity between the inner surface thereof and the inner surface of said fixed die when said movable die contacts said fixed die, and a shot sleeve opening into said cavity through which molten metal is injected, said method comprising the steps of:

moving said movable die to contact said fixed die, so that said die cavity is formed;

introducing tip lubricant into said shot sleeve so as to keep substantially all of said tip lubricant in said shot sleeve;

pouring metal molten metal into said shot sleeve;

injecting said molten metal into said die cavity to cause said tip lubricant to be conveyed into said die cavity by the movement of said molten metal so as to coat the inner surface of said die cavity prior to said molten metal touching said die cavity inner surface;

solidifying said metal in said die cavity; and detaching said movable die from said fixed die and detaching the solidified metal from said die cavity.

6. A die-casting method as in claim 5 wherein said introducing step introduces said tip lubricant into said shot sleeve through a pouring port of said shot sleeve.

7. A die-casting method as in claim 5 wherein said introducing step introduces said tip lubricant into said shot sleeve from a passage between said die cavity and said shot sleeve.

8. A die-casting method as in claim 5 wherein said introducing step introduces said tip lubricant into said shot sleeve with a high pressure air.

9. A die-casting apparatus comprising:

a fixed die;

a movable die forming a die cavity between an inner surface thereof and an inner surface of said fixed die when said movable die contacts said fixed die;

a shot sleeve opening to said die cavity, said shot sleeve having a pouring port through which molten metal is introduced;

shot plunger means for injecting said molten metal in said shot sleeve toward said die cavity; and nozzle means provided at a passageway between said shot sleeve and said die cavity and extending toward said shot sleeve from said die cavity for injecting tip lubricant only toward said shot sleeve.

10. A die-casting apparatus claimed in claim 9 wherein said nozzle means is slidably mounted in said movable die.

11. A die-casting apparatus claimed in claim 9 wherein said nozzle means projects into said passageway only when said nozzle injects said tip lubricant.

* * * * *